United States Patent [19]

Betka et al.

[11] Patent Number: 4,925,052

[45] Date of Patent: May 15, 1990

[54] INFANT'S MUG

[76] Inventors: Malcolm Betka, 32, Inner Loop Road, Beachley, Chepstow, Gwent. NP6 7HF; Robert Cross, 11, Monk Street, Monmouth, Gwent., both of United Kingdom

[21] Appl. No.: 244,517

[22] Filed: Sep. 9, 1988

[51] Int. Cl.[5] ..... B65D 41/00

[52] U.S. Cl. ..... 220/90.4; 220/366

[58] Field of Search ..... 220/90.4, 366

[56] References Cited

U.S. PATENT DOCUMENTS

| | | | |
|---|---|---|---|
| 2,437,784 | 3/1948 | Laskin | 65/13 |
| 2,545,350 | 3/1951 | Fuld | 222/484 |
| 2,839,229 | 6/1958 | Scheswohl | 220/90.4 X |
| 3,104,039 | 9/1963 | Dike | 222/536 |
| 3,730,399 | 5/1973 | Dibrell et al. | 220/90.4 X |
| 3,739,938 | 6/1973 | Daz | 220/90.4 |
| 4,394,928 | 7/1983 | Philip | 220/366 |

FOREIGN PATENT DOCUMENTS

| | | |
|---|---|---|
| 0196198 | 10/1986 | European Pat. Off. . |
| 2172793 | 10/1986 | United Kingdom . |

*Primary Examiner*—Steven M. Pollard

*Attorney, Agent, or Firm*—Young & Thompson

[57] ABSTRACT

A drinking vessel has a cylindrical body (1) forming the main receptacle, and a lid (2) with a snap fit over the rim of the body. The lid has a mouthpiece (6) diametrically opposed to a vent (8) and when turned to one position both are blocked. But when turned to another position, both are opened to the interior of the body (1) by ducts (11) in an inner flange (10) of the lid registering with recesses (5) in the rim of the body.

3 Claims, 1 Drawing Sheet

INFANT'S MUG

This invention relates to drinking vessels It is primarily concerned with those for infants, although it could be equally applicable to invalids or the disabled.

Children have a penchant for knocking things over, and the fuller and messier the contents, the more liable this is to happen Drinking mugs are a favourite target, although their disaster-rating has been partially lowered by providing a lid with a mouthpiece having a narrow aperture. This reduces an accident to a trickle rather than a flood, but if it is left unattended, the end result is just the same.

It is the aim of this invention to provide an improved closure which can completely seal the mug whenever it is not in actual use, but which is easily adjustable for drinking.

According to the present invention there is provided a drinking vessel comprising a receptacle with a lid, the lid having a mouthpiece and a vent separate therefrom, there being a first closure position for the lid in which there is no access for the liquid in the receptacle to the mouthpiece and the vent is closed, and a second closure position in which there is such access, and the vent is opened.

In the preferred form, the lid has an annular flange formation which fits a circular rim of the receptacle, allowing the lid to be rotated between positions.

Conveniently, the mouthpiece and the vent are at diametrically opposite positions on the lid, near the edge thereof.

Preferably, the flange formation comprises two concentric annular flanges which closely embrace the rim of the receptacle. The rim may have a snap fit engagement with the outer one of said flanges, positively to retain the lid on the receptacle. The inner flange may have ducts which, in the first closure position, are closed by the wall of the receptacle, thus sealing off the interior. In the second closure position they register with inwardly facing recesses in the rim portion of the receptacle so that there is access for liquid from the interior to the space within the rim which communicates with the mouthpiece. The vent is then also open to the interior.

For a better understanding of the invention, one embodiment will now be described, by way of example, with reference to the accompanying drawing, in which.

Figure 1:
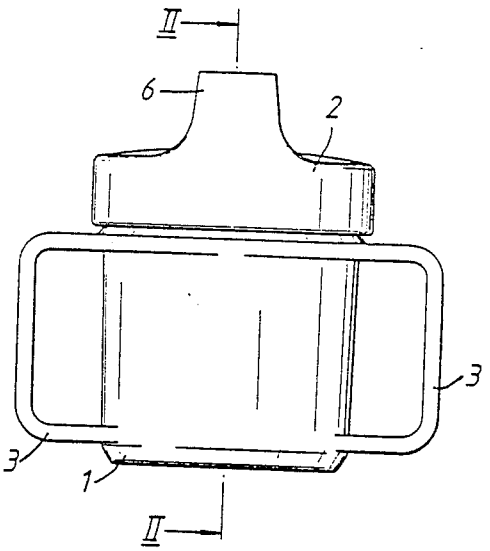
FIG. 1 is a front elevation of an infant's drinking mug ready to use.

The mug has a generally cylindrical main body 1, and a lid 2, each integrally formed from moulded plastics. The body 1 has two diametrically opposite handles 3 and at the upper end or rim there is an out-turned lip 4. Inside this lip and extending a short distance down into the body 1 there are two diametrically opposite shallow recesses 5 symmetrically placed circumferentially between the handles 3.

Figure 2:
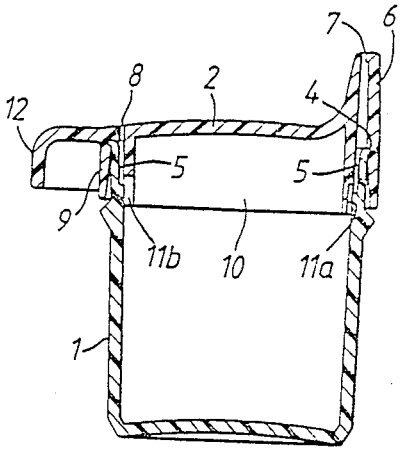
FIG. 2 is a section on the line II—II of FIG. 1.
Figure 3:
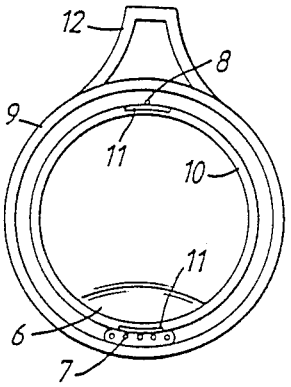
FIG. 3 is an underneath plan view of the lid of the mug.
Figure 4:
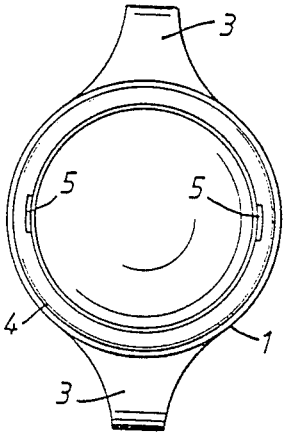
FIG. 4 is a plan view of the mug without its lid.

The lid 2 has an upwardly projecting mouthpiece 6 at its periphery, with holes 7 for passage of liquid. Diametrically opposite this there is a vent hole 8 just inwards of the edge. The lid also has two downwardly projecting concentric annular flanges 9 and 10, the mouthpiece 6 and the vent hole 8 being open to the space between them. The outer flange 9 is grooved on its inside so that it is a snap fit over the lip 4, while the inner flange 10 is slightly deeper and has a close sliding fit inside the rim portion of the cylindrical body 1. Beneath the mouthpiece 6 and vent hole 8 the inner flange 10 has ducts in the form of cut-outs **11*a*, as shown on the right hand side in FIG. 2, or shallow recesses 11*b* in the outer face, as shown on the left hand side, extending up from its lower edge. Alternatively, there could be apertures. When the lid 2 is properly fitted, these ducts 11 vertically overlap the recesses 5**.

When the lid 2 is turned so that the mouthpiece 6 is adjacent one of the handles 3 the ducts 11 are blocked by the rim portion of the body 1, and the mug is effectively closed. But when the lid 2 is turned either way so that the mouthpiece is mid-way between the handles 3, as in FIGS. 1 and 2, the recesses 5 and ducts 11 are open to one another. Liquid can then be drunk from the mug, passing through the ducts 11 and recess 5 beneath the mouthpiece 6, while the space within the mug is vented by the opposite recess and duct.

It will be appreciated that there is no need for exact positioning of the lid either for the drinking or the closed position.

The lid 2 has a projection 12 diametrically opposite the mouthpiece 2. This has a plan profile matching the handles 3 so that it gives a streamlined effect to the mug when in the out-of-use condition.

What we claim is:

1. A drinking vessel comprising a base receptacle with a circular rim and inwardly facing recesses in the rim portion, and a one-piece lid designed to fit retentively thereon but to be rotatable when so fitted, the lid having a mouthpiece, a vent separate from the mouthpiece, and two concentric annular flanges which closely embrace the rim of the receptacle, the inner flange having ducts to the mouthpiece and vent which is one rotated position of the lid are closed by the wall of the receptacle but which in another rotated position of the lid register with said recesses to provide communication between the interior of the receptacle and the mouthpiece and vent.

2. A drinking vessel according to claim 1, wherein said rim has snap fit engagement with the outer one of said flanges.

3. A drinking vessel according to claim 1, wherein the mouthpiece and the vent are at diametrically opposite positions on the lid, near the edge thereof.

* * * * *